United States Patent [19]

Altemose

[11] Patent Number: 4,494,788

[45] Date of Patent: Jan. 22, 1985

[54] HAND PORTABLE BOTTLE RACK

[75] Inventor: James L. Altemose, Malvern, Pa.

[73] Assignee: Creative Environments, Inc., King of Prussia, Pa.

[21] Appl. No.: 427,842

[22] Filed: Sep. 29, 1982

[51] Int. Cl.[3] ..... B65D 11/14

[52] U.S. Cl. ..... 294/161

[58] Field of Search ..... 294/159, 143, 160, 161; 220/334, 19, 22; 206/202

[56] References Cited

U.S. PATENT DOCUMENTS 3,628,709 12/1971 Clifton ..... 294/161

FOREIGN PATENT DOCUMENTS 369080 3/1932 United Kingdom ..... 294/159

*Primary Examiner*—James B. Marbert

*Attorney, Agent, or Firm*—Thorpe, North & Western

[57] ABSTRACT

A hand portable bottle rack for carrying and storing narrow-necked bottles includes a generally vertically oriented front panel having a plurality of openings therein, and a generally vertically oriented divider panel attached to the front panel to be perpendicular therewith. The openings in the front panel are positioned on each side of the joint of the divider panel and front panel. Below and toward the outside edge of each hole is a support peg which extends rearwardly of the front panel and generally parallel to the divider panel. The pegs are spaced from the divider panel a distance less than the diameter of the bottles to be supported. The openings in the front panel are of sufficient size to receive the necks of bottles so that when the neck of a bottle is inserted into an opening, the body of the bottle rests upon a corresponding peg and against the divider panel. A handle is formed in the divider panel rearwardly of the midpoint of the panel so that when the handle is grasped and lifted, the front panel tends to hang lower than the rest of the rack, and any bottles placed in the rack tend to move toward the front panel which restrains movement of the bottles beyond a certain point. In this manner, bottles can be easily placed in the rack and the rack lifted and carried to thus carry the bottles.

10 Claims, 3 Drawing Figures

HAND PORTABLE BOTTLE RACK

BACKGROUND OF THE INVENTION

This invention relates to a bottle rack which may be readily lifted and carried to thereby carry wine bottles and the like placed in the rack.

Racks or other structure for static storage of wine bottles are fairly common but racks suitable for both storing and carrying bottles are generally unknown. The usual mode for carrying bottles, especially wine bottles, is simply to place and carry the bottles in paper bags or other shopping bags. This, however, is not a particularly safe, secure or convenient way to carry bottles especially if more than one bottle needs to be carried. Also, bottles cannot be conveniently stored in such bags for later use.

BACKGROUND OF THE INVENTION

It is an object of the invention to provide a compact, simple to construct, and convenient to use hand portable bottle rack.

It is also an object of the invention to provide such a bottle rack which may be either easily carried by hand or placed on the floor, while securely holding bottles in either instance.

It is a further object of the invention to provide such a bottle rack which is esthetically attractive.

It is another object of the invention to provide such a rack in which bottles may be easily placed and from which bottles may be easily removed.

The above and other objects of the invention are realized in a specific illustrative embodiment thereof which includes a front panel having a plurality of spaced-apart openings for receiving the necks of bottles and for restraining movement of the bottles through the openings, a divider panel joined to the front panel between at least two horizontally adjacent openings and extending rearwardly of the front panel, and a plurality of pegs, each positioned below and toward the outside edge of a corresponding one of the openings and spaced from the divider panel a distance less than the diameter of the bottles to be carried. The divider panel is formed with a handle rearwardly of the midpoint of the panel so that when the handle is grasped and the rack is lifted, the front panel will tend to hang lower than the rest of the rack to thereby securely retain bottles placed in the rack—with the necks of the bottles being disposed in the openings in the front panel.

In accordance with one aspect of the invention, the bottom edges of the front panel and divider panel define a plane so that the rack may be stably placed on a flat surface.

DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
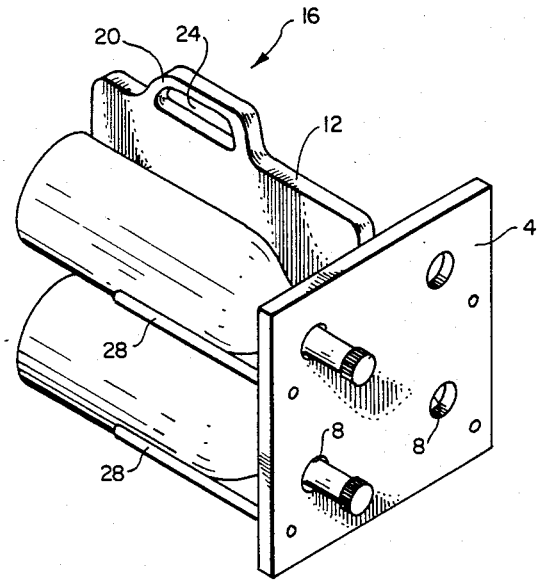
FIG. 1 is a perspective view of a bottle rack made in accordance with the principles of the present invention.
Figure 2:
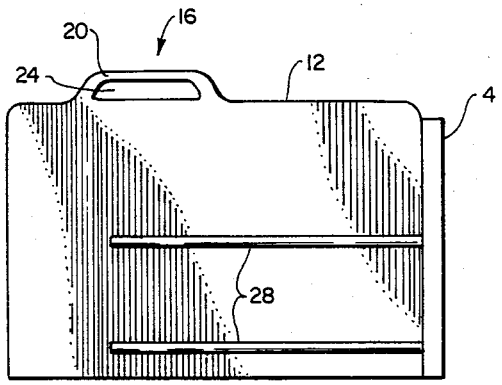
FIG. 2 is a side, elevational view of the bottle rack of FIG. 1.
Figure 3:
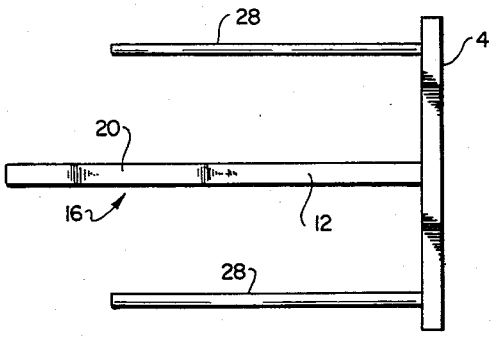
FIG. 3 is a top, plan view of the bottle rack.

Referring to the drawings, there is shown one illustrative embodiment of the bottle rack of the present invention. This embodiment includes a generally vertically-oriented front panel 4 made of wood or other suitable material. The panel 4 includes four generally circular openings 8 spaced apart both horizontally and vertically. The openings 8 are of sufficient size to receive a typical narrow-necked wine bottle and would typically be between 1.2 and 2.0 inches.

Joined to the front panel 4 at a vertical mid line thereof is a divider panel 12, similarly made of wood or other suitable material. The divider panel 12 is joined at its front edge to the rear surface of the front panel 4 and secured thereto by adhesive, screws, or other fastening means. The height of the divider panel 12 is substantially the same as the height of the front panel 4. The divider panel 12 extends rearwardly of the front panel to form a dividing wall between bottles which will be placed on the rack.

Formed in the top of the divider panel 12 is a handle 16 to facilitate lifting and carrying the rack. The handle 16 is formed by providing a raised portion 20 in the top edge of the divider panel 12 and then cutting out an opening 24 in the raised portion. The handle 16 is situated just rearwardly of the midpoint of the divider panel 12 so that when the handle is grasped and lifted by a person, the front panel 4 will tend to hang lower by reason of gravity than the rest of the rack. As will be clear from further discussion and description of the bottle rack, this facilitates the secure placement and carrying of bottles in the rack.

Mounted in the front panel 4 to extend rearwardly thereof are four pegs or dowels 28. Each dowel 28 is positioned just below and toward the outside edge of a respective opening 8 as best seen in FIG. 1. The dowels extend rearwardly generally parallel with the divider panel 12 and spaced therefrom a distance less than the diameter of the bottles to be carried in the rack. This spacing, of course, would vary depending upon the size of the bottle to be accomodated, but generally the spacing would be from about 2 inches to 2.5 inches. The dowels extend rearwardly of the front panel 4 a distance of between 5.0 and 10.0 inches, but in any case a sufficient distance to support the type of bottle to be carried in the rack. The vertical spacing of the dowels 28 is dependent upon the vertical spacing of the openings 8 which advantageously is between 2.6 and 3.2 inches between the centers of the opening.

With the structure described, wine bottles and the like may be easily put in place in the rack by inserting the neck of the bottle into an opening 8 and then allowing the body of the bottle to contact and rest on a corresponding dowel 28 and the divider panel 12. The bottom edges of the front panel 4 and divider panel 12 define a plane so that the rack may rest stably on a flat surface when not being carried. When the handle 16 is grasped and the rack is lifted, as earlier described, the front panel 4 tends to hang lower than the rest of the rack so that any bottles in the rack will tend to slide forwardly until the body of the bottles contact the perimeter of the openings 8 and are restrained from further movement thereby. The bottles are thus securely held in place in the rack when the rack is carried.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A hand portable bottle rack comprising a front panel having a plurality of spaced-apart openings for receiving the necks of bottles and for restraining movement of the bottles through the openings, a divider panel joined to the front panel between two horizontally adjacent openings and extending rearwardly, a pair of pegs extending rearwardly from the front panel, each positioned on a different side of said front panel below and toward the outside edge of a corresponding one of the two openings, said pegs being spaced from the divider panel a distance less than the width of the bottles to be supported, and a handle connected to the top of the divider panel at a location rearwardly of the front panel so that when the handle is grasped and lifted by a person, the front panel tends to hang lower than the rest of the rack.

2. A bottle rack as in claim 1 wherein the upper edge of the divider panel is formed to define said handle positioned rearwardly of the midpoint of the panel.

3. A bottle rack as in claim 2 wherein said handle comprises an elongate opening formed in the divider panel near the upper edge thereof.

4. A bottle rack as in claim 1 wherein the bottom edges of the front panel and the divider panel generally define a plane.

5. A bottle rack as in claim 1 wherein said front panel includes four openings, with two located one above the other on one side of the joint of the divider panel to the front panel and other two located one above the other on the other side of the joint of the divider panel and front panel, and wherein said support structure includes four pegs, each located below and toward the outside edge of a corresponding one of the openings and spaced from the divider panel a distance less than the width of the bottles to be supported.

6. A bottle rack as in claim 5 wherein the spacing between the divider panel and the pegs is about 2.25 inches.

7. A bottle rack as in claim 5 wherein the openings have a diameter of between 1.2 and 2.0 inches.

8. A bottle rack as in claim 5 wherein the vertical distance between the centers of the openings is between 2.6 and 3.2 inches.

9. A bottle rack as in claim 5 wherein said pegs extend out from the front panel a distance of between 5.0 and 10.0 inches.

10. A bottle rack as in claim 9 wherein said pegs comprise round dowels.

* * * * *